US005131858A

United States Patent [19]

Heimbrock

[11] Patent Number: 5,131,858

[45] Date of Patent: Jul. 21, 1992

[54] ARC SUPPRESSING CLUSTER ASSEMBLY

[75] Inventor: Henry H. Heimbrock, Lawrenceburg, Ind.

[73] Assignee: Standex International Corporation, Salem, N.H.

[21] Appl. No.: 658,007

[22] Filed: Feb. 20, 1991

[51] Int. Cl.[5] ..... H01R 13/53

[52] U.S. Cl. ..... 439/181; 439/685

[58] Field of Search ..... 439/271, 281, 283, 181, 439/186, 187, 685-687, 689, 278, 587

[56] References Cited

U.S. PATENT DOCUMENTS

| | | | |
|---|---|---|---|
| 2,728,060 | 12/1955 | Doeg | 439/685 |
| 2,875,426 | 2/1959 | Skony | 439/685 |
| 3,764,960 | 10/1973 | Heimbrock | 439/685 |
| 3,842,396 | 10/1974 | Olsson | 439/685 |
| 4,090,759 | 5/1978 | Herrmann, Jr. | 439/281 |
| 4,420,202 | 12/1983 | Atakkaan | 439/278 |
| 4,477,136 | 10/1984 | Smith | 439/271 |
| 4,621,883 | 11/1986 | Noguchi | 439/278 |
| 4,753,607 | 6/1988 | Heimbrock | 439/376 |

FOREIGN PATENT DOCUMENTS

| | | | |
|---|---|---|---|
| 0252601 | 1/1988 | European Pat. Off. | 439/587 |

*Primary Examiner*—David L. Pirlot
*Assistant Examiner*—Hien D. Vu
*Attorney, Agent, or Firm*—Wood, Herron & Evans

[57] ABSTRACT

Within a hermetically-sealed compressor, a cluster assembly provides the connection to a three-prong header so that power can be applied to the motor within the compressor. The walls of the compressor are closed as completely as possible except for openings for leads extending from the cluster block and for pins from the header projecting into the cluster block. Each pin has a ceramic collar that is surrounded by a skirt extending from the cluster block surface. The collar and skirt configuration more than doubles the length of the path that an arc must follow if there is arcing between pins.

4 Claims, 1 Drawing Sheet

ARC SUPPRESSING CLUSTER ASSEMBLY

This invention relates to a cluster assembly connection to a three pin header inside a hermetically-sealed compressor. The invention is particularly useful in applying power to a scroll compressor.

BACKGROUND OF THE INVENTION

A hermetically-sealed compressor, usually for air conditioning or refrigeration applications, has a sealed metal housing. A motor and compressor are mounted within the housing. The electrical power to the motor is connected through a known header sometimes referred to as a glass-to-metal seal.

The header is in the form of a cup-shaped metal support having three holes. A pin is mounted in each of the three holes and is mechanically supported in the cup-shaped element by glass which is bonded to both the pin and the metallic element.

Within the compressor, the three leads to the motor are terminated in connector clips each having a receptacle that slides down upon the pin. The three clips are mounted in a cluster block having three parallel passageways through which the connector clips and leads pass. The clips are equiangularly arrayed in a position to be pushed upon the three pins of the header, thereby forming the electrical connection between the motor and the header pins.

In the operation of the compressor, a problem of arcing between pins has been observed. That arcing can be of such magnitude as to destroy the header, thus rendering the whole compressor useless. This has been observed particularly in connection with the scroll compressor and is believed to arise out of the drawing of a vacuum within the compressor at startup, the vacuum tending to promote arcing between pins.

BRIEF SUMMARY OF THE INVENTION

The objective of the present invention has been to eliminate arcing at startup in a hermetically-sealed compressor.

The objective of the invention is attained by modifying the cluster block and the manner in which it cooperates with the header so as to more than double the path through the air between adjacent header pins that the arc must travel if there is to be any arcing at all.

More specifically, the cluster block has been modified to provide a projecting cylindrical insulative skirt surrounding each of the holes through which the header pins pass to make connection to the clips within the cluster block. Each pin on the header has an insulative collar completely surrounding the pin. Each skirt projecting from the cluster block is of a large enough diameter to completely surround the collar on the pin. When the cluster assembly is applied to the header with each pin making a connection to its respective clip, the insulative skirts of the cluster assembly slide down around the collars. With the cluster assembly applied in this manner, the air path from pin to pin includes the distance that the skirt extends from the cluster block at two adjacent pins. Thus, where the distance between pins, prior to the invention, is approximately 11/32nds of an inch, with the invention applied, the distance, through air, from pin to pin has been increased to approximately 24/32nds.

It has been found that the application of the invention to compressors with scroll motors has significantly reduced or eliminated the arcing problem.

BRIEF DESCRIPTION OF THE DRAWINGS

The several features and objectives of the invention will become more readily apparent from the following detailed description taken in conjunction with the accompanying drawings in which.

DETAILED DESCRIPTION OF THE INVENTION

Figure 1:
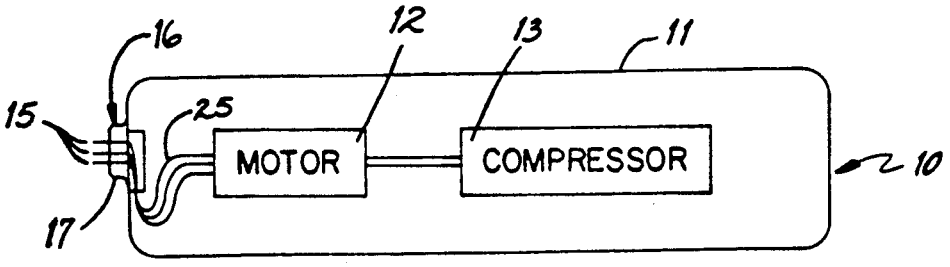
FIG. 1 is a diagrammatic, elevational view, partly in section, of the interior of a hermetically-sealed compressor.

Referring to FIG. 1, a hermetically-sealed compressor 10 has a housing 11 within which is contained a motor 12 connected to drive a compressor 13. The power to the motor, as, for example, a 220 volt, single phase three wire system, is applied to three pins 15 of a header 16. The header 16, best shown in FIGS. 2 and 3, has a cup-shaped metal element 17 which is welded to the housing 11 of the compressor 10. The cup-shaped element carries three pins 15 by means of glass beads 18. The beads 18 are sealed around the pins 15 and are sealed to the metal cup-shaped element 17.

Figure 2:
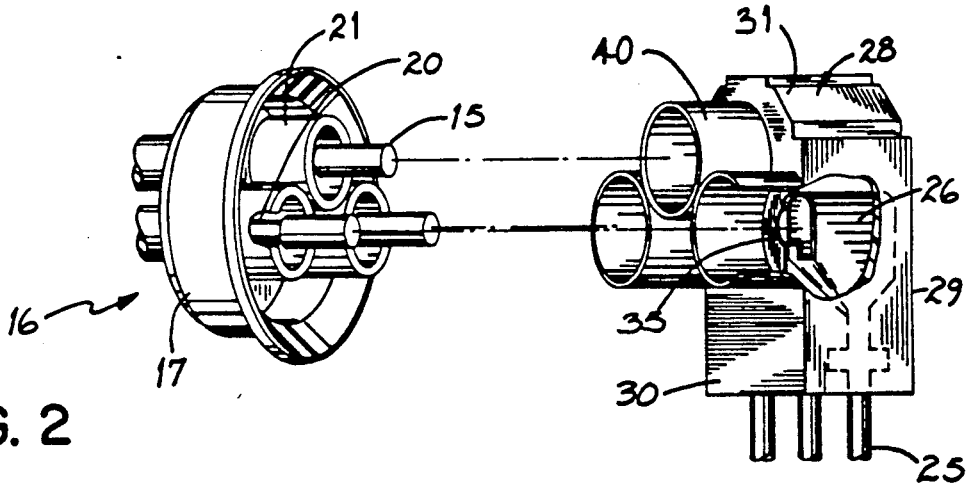
FIG. 2 is a disassembled perspective view of the header and cluster assembly.

Each pin is necked down as shown at 20 in FIG. 2 and is surrounded by a ceramic cylindrical collar 21. The reduction in diameter of each pin causes it to function as a fuse and the collar confines the flow of molten metal from a fused pin.

Figure 3:
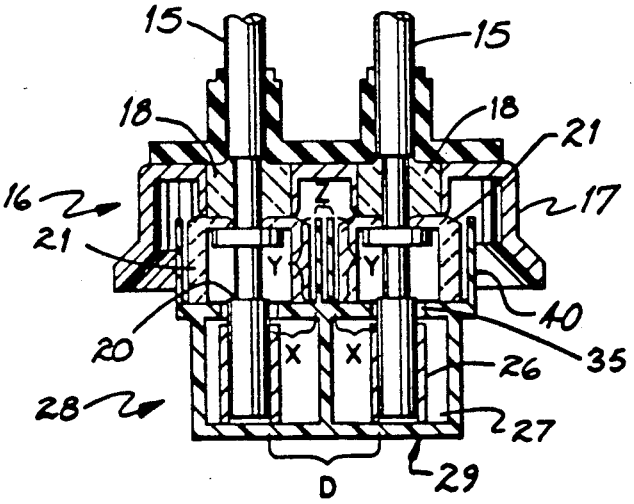
FIG. 3 is a cross-sectional view taken through two adjacent pins of the cluster assembly with the invention applied.

The motor has leads 25 which terminate in clips 26 (FIG. 3). The leads and the terminal clips 26 are disposed in longitudinal passageways 27 formed in a cluster block 28. An example of a cluster block is shown in U.S. Pat. No. 3,566,341 which is fully incorporated herein by reference. The cluster assembly has two opposed surfaces 29 and 30. The surface 29 is completely closed, as contrasted to what is shown in U.S. Pat. No. 3,566,341. Furthermore, the end 31 of the cluster block is closed as contrasted to the cluster block of U.S. Pat. No. 3,566,341.

The surface 30 has three key-shaped holes 35 that are equiangularly spaced and aligned with the pins 15. The clips 26 attached to the leads 25 are aligned with those holes so that when the cluster block or cluster assembly is pushed upon the pins 15 of the header 16, the pins will enter the clips 26 and make electrical connection therewith thereby connecting the motor 12 to the power supply connected to the outside of the header 16.

In accordance with the present invention, each hole 35 of the block 28 is surrounded by a dielectric or insulative skirt 40. Each skirt 40 is cylindrical and has an inside diameter that is larger than the outside diameter of the collars 21 on the header 16. When the cluster assembly 28 is applied to the header 16, the skirts 40 surround the collars 21 as shown in FIG. 3. This creates a long pathway through the air for an arc to travel between adjacent pins. More particularly, absent the skirts 40, the arc between adjacent pins had to travel a distance D directly from one pin to the other as shown in FIG. 3. In a typical header, that distance would be approximately 11/32nds of an inch.

With the application of the skirt 40, the arc must travel through a tortuous path consisting of two segments of length X, two segments of length Y between the skirt 40 and collar 21, and one segment of length Z across the two collars 40. The sum of those distances is about 24/32nds of an inch, or more than twice the distance of the previous arc path. Furthermore, the tortuous character of the path further reduces the likelihood that an arc will jump from one pin to another.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

What is claimed is:

1. A cluster block for application to a three pin header on the inside of a hermetically-sealed compressor, said header having a cylindrical collar surrounding each pin comprising:

a block of insulative material, said block having three parallel passageways, open at one end of said block, each passageway for the receipt of a clip and attached lead, said block being closed at the opposite end of each passageway, said block having two surfaces parallel to said passageways, one of said surfaces having three equiangularly-spaced holes aligned with said clips, three elongated skirts, each said skirt being integral with the block and depending from said one surface and encircling a hole, each skirt being of an inside diameter larger than the outside diameter of said collar to create an airspace between skirt and collar when said skirt surrounds said collar, whereby when a cluster block is applied to a header, each said skirt surrounds a collar and approximately doubles the distance an arc must travel from pin to pin.

2. A cluster block as in claim 1 in which said skirt has a diameter of approximately one-half inch and a length of approximately one-fourth inch.

3. A cluster block as in claim 1 in which all exterior surfaces of said block are closed except said pin-receiving holes and three entrances for lead wires.

4. A cluster block for application to a three pin header on the inside of a hermetically-sealed compressor, said header having a cylindrical collar surrounding each pin comprising:

a block of insulative material, said block having three parallel passageways, open at one end of said block, each passageway for the receipt of a clip and attached lead, said block having two surfaces parallel to said passageways, one of said surfaces having three equiangularly-spaced holes aligned with said clips, three elongated skirts depending from said one surface, each said skirt being integral with said block and encircling one of said holes, each skirt being of an inside diameter larger than the outside diameter of said collar to create an airspace between skirt and collar when said skirt surrounds said collar, whereby when a cluster block is applied to a header, each said skirt surrounds a collar and approximately doubles the distance an arc must travel from pin to pin.

* * * * *